US006086447A

United States Patent [19]

Tucker

[11] Patent Number: 6,086,447

[45] Date of Patent: Jul. 11, 2000

[54] DOLL HAVING HEAD ATTACHMENT POST INTEGRAL WITH BODY

[75] Inventor: James I. Tucker, Manhattan Beach, Calif.

[73] Assignee: Mattel, Inc., El Segundo

[ * ] Notice: Under 35 U.S.C. 154(b), the term of this patent shall be extended for 201 days.

[21] Appl. No.: 08/516,245

[22] Filed: Aug. 17, 1995

[51] Int. Cl.[7] ..... A63H 3/36

[52] U.S. Cl. ..... 446/384; 446/391

[58] Field of Search ..... 446/100, 120, 446/391, 376, 381, 383, 384

[56] References Cited

U.S. PATENT DOCUMENTS

| | | | |
|---|---|---|---|
| 487,861 | 12/1892 | Verpillier | 446/381 |
| 2,756,540 | 7/1956 | Cleaver . | |
| 2,838,873 | 6/1958 | Taylor . | |
| 3,866,350 | 2/1975 | Goldfarb | 446/383 |
| 3,881,276 | 5/1975 | Kosicki et al. . | |
| 3,940,880 | 3/1976 | Kaelin et al. . | |
| 4,103,451 | 8/1978 | Kawada et al. . | |
| 4,143,453 | 3/1979 | Taluba . | |
| 4,758,200 | 7/1988 | Von Moltke . | |
| 4,968,282 | 11/1990 | Robson | 446/383 |
| 4,988,324 | 1/1991 | Ryaa et al. . | |
| 5,044,960 | 9/1991 | De Porteous . | |
| 5,153,976 | 10/1992 | Benchaar et al. . | |
| 5,230,580 | 7/1993 | Henkel . | |
| 5,257,873 | 11/1993 | Abbat . | |

FOREIGN PATENT DOCUMENTS

| | | | |
|---|---|---|---|
| 236788 | 5/1945 | Germany | 446/384 |
| 234484 | 2/1989 | Japan | 446/376 |
| 133751 | 11/1951 | U.S.S.R. | 446/383 |
| 1354189 | 5/1974 | United Kingdom | 446/383 |

*Primary Examiner*—Robert A. Hafer
*Assistant Examiner*—Jeffrey D. Carlson
*Attorney, Agent, or Firm*—Roy A. Ekstrand

[57] ABSTRACT

A doll includes a body having an integrally formed upwardly extending attachment post. The attachment post defines a spherical surface joined to a ball end to define a narrow portion at the junction thereof. A doll head is formed of a flexible resilient material having an interior cavity and bottom surface. A recess and surrounding wall is formed in the bottom surface of the doll head and includes a tapered aperture and an inwardly extending edge. The doll head is assembled to the attachment post by forcing the ball end through the recess and tapered aperture such that the inwardly extending edge is received within the narrow portion of the attachment post.

8 Claims, 1 Drawing Sheet

DOLL HAVING HEAD ATTACHMENT POST INTEGRAL WITH BODY

FIELD OF THE INVENTION

This invention relates generally to the fabrication of dolls and toy figures and particularly to the head attachment used therein.

BACKGROUND OF THE INVENTION

The modern mass production assembly and fabrication of molded plastic dolls and toy figures has become a major factor in providing high quality, low cost doll and toy figure products. The use of molded plastic components makes possible the provision of extremely precise, highly detailed and accurate components for doll or toy figure fabrication. In addition, the assembly of dolls or toy figures from molded components also provides a ready mechanism for including articulated joints within the doll. Thus, for example, dolls and toy figures are readily provided which have movable limbs and heads further adding to the play value of the doll or toy figure. One of the primary objectives toward which practitioners in the art direct their design efforts is the avoidance of fasteners or adhesive attachment in the assembly of such dolls or toy figures. It has been found that fasteners in particular are costly and represent potential safety hazards in many instances due their capability to become dislodged and swallowed by young children. Adhesive attachments have often been found to be subject to fatigue and breakage prematurely terminating the useful life of an otherwise high quality doll or toy figure.

To minimize or preferably eliminate the use of such fasteners and adhesive attachments, practitioners often resort to the use of snap-in type joints. Thus, for example, it is quite common for a modern mass-produced doll or toy figure to have the head as well as the arm and leg appendages snap-fit attached to the doll torso. It has been found that the head attachment in a snap-fit manner has been subject to particular difficulties and limitations. Generally, doll fabricators include a head post component which is received within the upper torso cavity of the doll and extends through an upper aperture forming the doll neck. The head is then secured to the upper end of the attachment post. Often the head is formed of two mating parts joined to captivate the head post and complete the head attachment. In the face of difficulties in attaching the doll's head, practitioners in the art have provided various apparatus. For example, U.S. Pat. No. 4,143,453 issued to Taluba sets forth an APPENDAGE SUCH AS A DOLL'S HEAD, A METHOD FOR BLOW MOLDING SAME OF ELASTOMER MATERIAL, AND A METHOD FOR SECURING SAME TO A BODY in which a doll head is formed of an elastomer material and is blow molded to include a downwardly extending annular lip having a semi-cylindrical groove at the front of the neck. The lip is constructed to fold inwardly and to engage a bead or flange on the neck portion of the body thereby securing the head to the body.

U.S. Pat. No. 3,940,880 issued to Kaelin, et al. sets forth DOLL JOINT STRUCTURES used for connecting the limbs of a toy figure or doll to the torso. The torso defines a plurality of concave sockets which in turn receive an attachment post having a coupling to the appendage. The appendage includes a ball portion received within the socket to provide pivotal attachment.

U.S. Pat. No. 4,103,451 issued to Kawada, et al. sets forth a DOLL WITH NECK DETACHABLY SECURED BETWEEN OPPOSED BABY MEANS PORTIONS in which an articulated toy doll arrangement includes a head, a body, arms and legs and a neck means interconnecting the head to the body. The mounting of the neck means for head connection to the body is such that at least rotational movement of the head relative to the body is provided. The body portion defines a socket which receives a ball supported upon a post extending downwardly from the head.

U.S. Pat. No. 2,756,540 issued to Cleaver sets forth a DOLL REMOVABLE HEAD having a torso supporting an upwardly extending resilient spring clasp from the neck thereof. A plurality of doll heads each defining hollow interior cavities and a transversely extending post are snap-fitted to the torso by engaging the resilient clasp.

U.S. Pat. No. 2,838,873 issued to Taylor sets forth a DOLL WITH REMOVABLE OR INTERCHANGEABLE HEADS in which a doll torso defines a downwardly extending passage which receives a correspondingly shaped downwardly extending post supported on the underside of the doll head. Engagement means within the torso secure the head post to the torso interior.

U.S. Pat. No. 3,881,276 issued to Kosicki, et al. set forth a DOLL INCLUDING A JOINT MEMBER WITH FILLING OPENING AND GAS VENT THEREIN in which appendages are secured to a doll torso using a snap-fit attachment which further defines an interior passage through each attachment element.

U.S. Pat. No. 4,758,200 issued to VonMoltke sets forth a DOLL ASSEMBLY AND METHOD THEREFOR having a head defining an interior cavity and a neck passage therethrough. The torso defines an upwardly extending flexible sleeve within which a ball is captivated. The sleeve connects the ball and shoulders of the torso to secure the head.

U.S. Pat. No. 4,450,129 issued to Dunn, et al. sets forth a MAKING OF MAKING MINIATURE DOLL HEADS in which an oversized head is formed of a shrinkable plastisol including a plasticizer and in which facial features are applied to the head using a shrinkable paint. The head is reduced in size by extracting the plasticizer from the plastisol forming a miniature head.

U.S. Pat. No. 5,257,873 issued to Abbat sets forth an ARTICULATED DOLL JOINT for movably connecting proximal and distal workpieces such as limbs of a doll or mannequin. The attachment includes a first shank having first positioning means at one of its ends and a second positioning means at its other end. The first positioning means and second positioning means are movably connected by means of a joint molded thereabout.

U.S. Pat. No. 5,044,960 issued to DePorteous sets forth a MODEL CONSTRUCTION in which a model skeleton comprises a plurality of interconnected members with hinge joints joining at least some of the adjacent members for articulation. Each hinge joint has a pair of projections engaging the wall portion of an adjacent member for relative rotation.

U.S. Pat. No. 4,988,324 issued to Ryaa, et al. sets forth a TOY FIGURE BALL AND SOCKET JOINT in which one joined member defines a socket while the other supports a ball sized to fit within the socket. To ensure long term frictional stability between the movable parts, the socket portion includes a pair of opposed walls engaging the ball face.

U.S. Pat. No. 5,153,976 issued to Benchaar, et al. and U.S. Pat. No. 5,230,580 issued to Henkel set forth various ball and socket joints used in industries unrelated to the toy figure industry.

While the foregoing described prior art devices have provided some improvement in the art and in some instances enjoyed commercial success, there remains nonetheless a continuing need in the art for evermore improved, effective and low cost methods and apparatus for assembling dolls and toy figures.

SUMMARY OF THE INVENTION

Accordingly, it is a general object of the present invention to provide an improved doll or toy figure. It is a more particular object of the present invention to provide an improved doll or toy figure having a head attachment post integral with the body which reduces the fabrication costs of the doll or toy figure.

In accordance with the present invention, there is provided a doll comprising: a body; a head attachment post integrally formed with the body and defining an extending neck portion having a spherical surface, a ball end joined to the neck portion and a narrow portion formed at the junction of the spherical surface and the neck portion; and a head defining an interior cavity for receiving a portion of the head attachment post, the head including a spherical recess having a surrounding wall and a tapered aperture extending from the spherical recess forming an inwardly extending edge between the spherical recess and the tapered aperture, the wall stretching to receive the ball end into the interior cavity through the spherical recess and the aperture and contracting to engage the narrow portion of the head attachment post.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
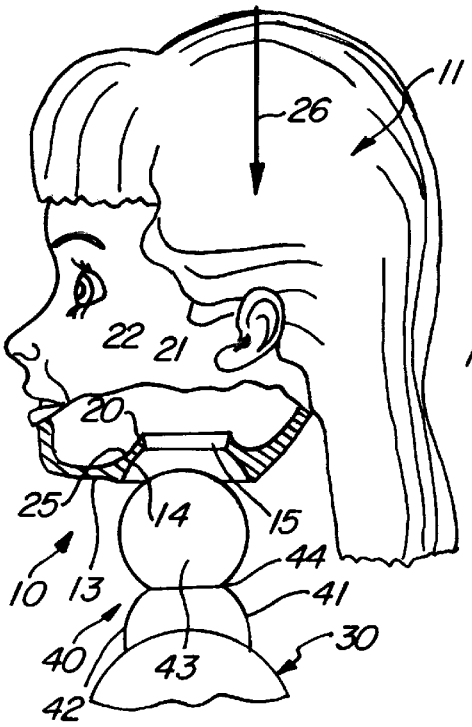
FIG. 1 sets forth a partially sectioned assembly view of a doll constructed in accordance with the present invention.

FIG. 1 sets forth a partially sectioned assembly view of a doll constructed in accordance with the present invention and generally referenced by numeral 10. Doll 10 includes a head 11 formed of resilient molded plastic material and defining an interior cavity 12. Head 11 further defines a bottom surface 13 having a spherical recess 14 extending upwardly from bottom surface 13. An aperture 15 is formed within the interior of recess 14 and is encircled by a rim portion 20. Aperture 15 defines a tapered surface 21 which narrows downwardly forming an edge 22 at the intersection of spherical recess 14 and surface 21.

In accordance with the present invention, head 11 is preferably formed of a flexible resilient molded plastic material such that wall 25 surrounding recess 14 and terminating in rim 20 at its upward end is flexible and resilient. As is better understood below, interior cavity 12 is sufficient in size to easily receive attachment post 40.

Doll 10 further includes a body 30 fabricated in accordance with conventional fabrication techniques to support a torso portion to which arm and leg appendages are secured by conventional attachment means (not shown). Doll 30 further includes an integrally formed upwardly extending head attachment post generally referenced by numeral 40. Head attachment post 40 and body 30 are preferably formed of a molded plastic material or the like. Attachment post 40 includes an upwardly extending neck portion 41 defining a spherical surface 42. Attachment post 40 terminates in a spherical ball end 43 which meets spherical surface 42 to form a narrow portion 44. In the preferred embodiment of the present invention, the radius of curvature of ball end 43 is substantially equal to that of surface 42. In addition and in further accordance with the preferred fabrication of the present invention, spherical recess 14 formed in head 11 also defines a radius of curvature substantially equal to that of spherical surface 42.

In the assembly view of FIG. 1, head 11 is separate from head attachment post 40 and is aligned to properly position recess 14 and aperture 15 in general alignment with the vertical center axis of head attachment post 40. The assembly of head 11 to body 30 and attachment post 40 is carried forward by forcing head 11 downwardly in the direction indicated by arrow 26 such that ball end 43 is received within recess 14.

Figure 2:
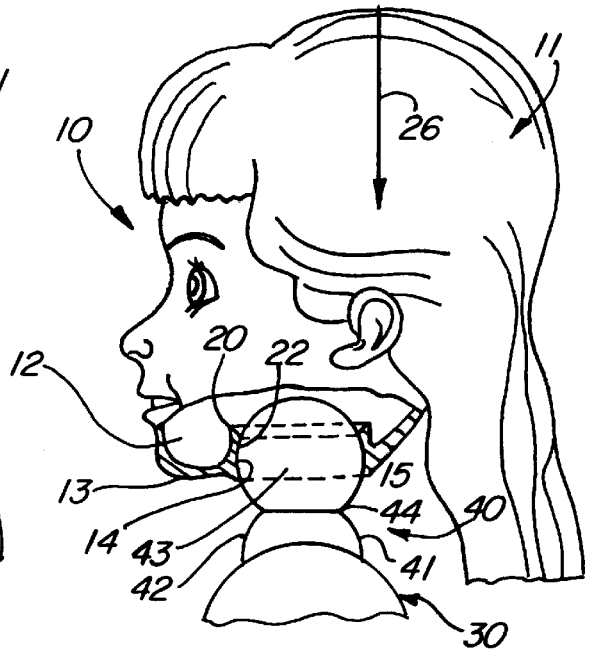
FIG. 2 sets forth a partially sectioned assembly view of the present invention doll during the initial assembly of the head to attachment post.

FIG. 2 sets forth a partial section view of doll 10 during the assembly of head 11 to attachment post 40. As described above, doll 10 includes a head 11 formed of a resilient flexible material such as molded plastic and defining an interior cavity 12 and a bottom surface 13. Bottom surface 13 in turn defines a spherical recess 14 and an aperture 15. A wall 25 surrounds recess 14 and terminates at its interior in a rim 20. Aperture defines a tapered surface 21 which intersects recess 14 to form an inwardly projecting edge 22. Doll 10 also includes a bottom 30 fabricated in accordance with conventional fabrication techniques having an integrally formed attachment post 40 extending upwardly from body 30. Attachment post 40 includes a neck portion 41 having a spherical surface 42 formed thereon and a terminating ball end 43. Ball end 43 and spherical surface 42 intersect to form a narrow portion 44.

As can be seen in FIG. 2, head 11 is forced downwardly in the direction indicated by arrow 26. As can be seen, the resilience of wall 25 and rim 20 allows recess 14 and aperture 15 to expand and receive ball end 43. As mentioned above, the configuration shown in FIG. 2 represents an intermediate assembly position as head 11 is forced downwardly in the direction of arrow 26. Thus, as head 11 continues to be forced downwardly, ball end 43 of attachment post 40 is moved upwardly within recess 14 as the latter expands and is ultimately forced through recess 14 and aperture 15 to the fully assembled position shown in FIG. 3.

Figure 3:
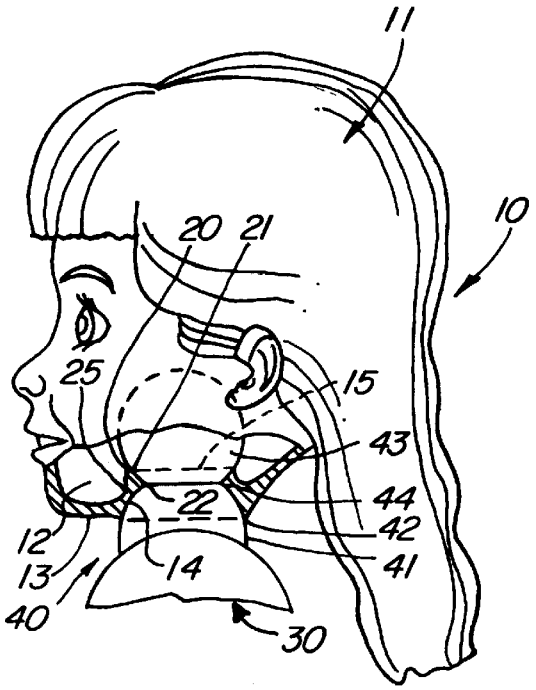
FIG. 3 sets forth a partially sectioned side view of a doll constructed in accordance with the present invention having the head assembled to the head attachment post.

FIG. 3 sets forth a partial section view of doll having head 11 fully assembled to attachment post 40. As can be seen in the fully assembled position, ball end 43 is received within interior cavity 12 of head 11. As described above, doll 10 includes a head 11 formed of a resilient flexible material such as molded plastic and defining an interior cavity 12 and a bottom surface 13. Bottom surface 13 in turn defines a spherical recess 14 and an aperture 15. A wall 25 surrounds recess 14 and terminates at its interior in a rim 20. Aperture 15 defines a tapered surface 21 which intersects recess 14 to form an inwardly projecting edge 22. Doll 10 also includes a bottom 30 fabricated in accordance with conventional fabrication techniques having an integrally formed attachment post 40 extending upwardly from body 30. Attachment post 40 includes a neck portion 41 having a spherical surface 42 formed thereon and a terminating ball end 43. Ball end 43 and spherical surface 42 intersect to form a narrow portion 44.

Thus, in the fully assembled positioned of FIG. 3, surface 21 of aperture 15 is drawn against the underlying surface of ball end 43 due to the resilience of wall 25 and rim 20. Edge 22 formed between aperture 15 and recess 14 is received within narrow portion 44 of attachment post 40. Recess 14 is received upon and configures to the underlying portion of spherical surface 42. The contact between recess 14 and surface 21 of aperture 15 against surface 42 and ball end 43 is a resilient contact which due to the molded plastic materials used in fabrication of head 11 and attachment post 40 facilitates the rotation of head 11 upon attachment post 40. During this rotation, edge 22 continues to engage narrow portion 44 as recess 14 and surface 21 of aperture 15 slide upon the underlying portions of surface 42 and ball end 43 respectively. Because head 11 is fabricated of a flexible resilient material, head 11 may be tilted with respect to body 30 and attachment post 40 to a small degree as the material of head 11 deforms. Importantly, however, the resilience of the material of head 11 returns head 11 to the proper orientation of FIG. 3 immediately upon release of any distorting force or pressure. The attachment of head 11 is secure and provides substantial resistance to the separation of head 11 from attachment post 40. Most importantly, the assembly of head 11 to body 30 is carried forward in the manner shown in FIGS. 1, 2 and 3 sequentially to provide a simple easily performed assembly operation in which no additional fasteners or attachment apparatus are required. The attachment between head 11 and attachment post 40 facilitates the rotational movement or pivoting of head 11 while maintaining this secure attachment.

Figure 4:
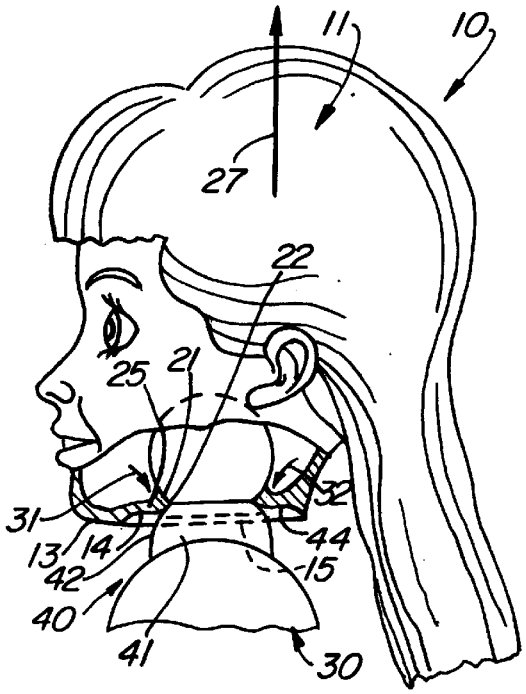
FIG. 4 sets forth a partial section view of a doll constructed in accordance with the present invention showing the response of the doll head attachment to separating forces.

FIG. 4 sets forth a partial section view of the present invention doll responding to attempted separation of head 11 from body 30. More specifically, FIG. 4 sets forth the response of the present invention attachment of head 11 as a withdrawing force in the direction indicated by arrow 27 is applied to head 11 with respect to body 30. As described above, doll 10 includes a head 11 formed of a resilient flexible material such as molded plastic and defining an interior cavity 12 and a bottom surface 13. Bottom surface 13 in turn defines a spherical recess 14 and an aperture 15. A wall 25 surrounds recess 14 and terminates at its interior in a rim 20. Aperture 15 defines a tapered surface 21 which intersects recess 14 to form an inwardly projecting edge 22. Doll 10 also includes a bottom 30 fabricated in accordance with conventional fabrication techniques having an integrally formed attachment post 40 extending upwardly from body 30. Attachment post 40 includes a neck portion 41 having a spherical surface 42 formed thereon and a terminating ball end 43. Ball end 43 and spherical surface 42 intersect to form a narrow portion 44.

Thus, as head 11 is drawn away from body 30 in the direction indicated by arrow 27, attachment post 40 including ball end 43 is displaced downwardly relatively to head 11 toward bottom surface 13. As head 11 continues to be drawn away from attachment post 40, edge 22 continues to engage narrow portion 44 of attachment post 40 while surface 21 of aperture 15 continues to contact the underlying portion of ball end 43. This engagement causes wall portion 25 to be deformed and flexed downwardly about ball end 43 in the direction indicated by arrows 31 and 32. It will be understood that this downward flexing of wall 25 occurs on all sides of narrow portion 44 of attachment post 40 due to the encircling of narrow portion 44 by edge 22. As wall portion 25 continues to be flexed downwardly, the positioned depicted in FIG. 4 is reached and a maximum of resisting force is provided. A substantial portion of the resisting force provided by wall 25 occurs due to the compressive force exerted against attachment post 40 due to the curving and downward flexing of wall 25. With temporary reference to FIG. 3, it will be noted that in the normal assembled position of the present invention doll, wall portion 25 defines a greater length than that which is exhibited in FIG. 4 as the downward flexing of wall 25 occurs. The shortening or compressing of wall 25 provides a resisting force due to the resilience of the material from which head 11 is formed. In addition, the combination of edge 22 and surface 21 of aperture 15 cooperate with the curvature of ball end 43 to provide a further resisting component preventing the separation of attachment post 40 from head 11. In essence, the combination of wall 25, rim 20 and edge 22 engaging ball end 43 and narrow portion 44 tends to collapse upon itself under compression as head 11 is drawn from body 30 making removal of head 11 difficult and securing the head attachment. It will be apparent to those skilled in the art, however, that a continued and increased force upon head 11 in the direction of arrow 27 eventually overcomes this securing force and sufficiently stretches and distorts wall 25 and rim 20 to allow attachment post 40 to be withdrawn from head 11. It will be equally apparent, however, that this force is substantial and is much greater than the original assembly force applied in assembling head 11 to attachment post 40. Thus, the attachment of head 11 is remarkably secure despite its ease of assembly due to the cooperation of wall 25, rim 20 and edge 22 together with surface 21 of aperture 15 and ball end 43 and narrow portion 44.

What has been shown is a doll having head attachment post integral with the doll body which utilizes a resilient flexible material head having a receiving aperture and surrounding wall which cooperates with the attachment post to reliably secure the doll head in a pivotal attachment. The assembly is carried forward with a simple forced or snap-in insertion and separation or disassembly of the head from the attachment post is strongly resisted by the structure of the head attachment and its cooperation with the integrally formed head attachment post.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a body;

a head attachment post integrally formed with said body and defining an extending neck portion having a spherical surface, a ball end joined to said neck portion and a narrow portion formed at the junction of said spherical surface and said ball end; and a head defining an interior cavity for receiving a portion of said head attachment post, said head including a spherical recess having a surrounding wall and a tapered aperture extending from said spherical recess forming an inwardly extending edge between said spherical recess and said tapered aperture, said wall stretching to receive said ball end into said interior cavity through said spherical recess and said aperture and contracting to engage said narrow portion of said head attachment post such that said inwardly extending edge is seated within said narrow portion and said tapered aperture is seated upon said ball end and said spherical recess is seated upon said spherical surface.

2. A doll as set forth in claim 1 wherein said spherical surface, said ball end and said spherical recess each define substantially equal radii of curvature.

3. A doll as set forth in claim 2 wherein said spherical recess extends to substantially cover said spherical surface when said head is assembled to said head attachment post.

4. A doll comprising:

a body having an integrally formed upwardly extending head attachment post, said head attachment post defining a generally cylindrical neck portion defining a spherical surface, a ball end and a narrow portion therebetween; and a hollow doll head formed of a flexible resilient material and having a generally spherical recess formed therein which defines an inwardly extending edge and an upwardly open aperture extending from said edge, said doll head being assembled to said head attachment post by forcing said ball end through said spherical recess, past said inwardly extending edge and through said upwardly open aperture and seating said inwardly extending edge within said narrow portion of said attachment post such that said upwardly open aperture is seated against said ball end and said spherical recess is seated against said spherical surface.

5. A doll as set forth in claim 4 wherein said body and head attachment post are formed of a common molded plastic member.

6. A doll as set forth in claim 5 wherein said neck portion defines a spherical surface extending to said narrow portion.

7. A doll as set forth in claim 6 wherein said spherical surface, said ball end and said spherical recess each define substantially equal radii of curvature.

8. A doll as set forth in claim 7 wherein said spherical recess extends to substantially cover said spherical surface when said head is assembled to said head attachment post.

* * * * *